US012571171B2

(12) United States Patent
Bungarten et al.

(10) Patent No.: US 12,571,171 B2
(45) Date of Patent: Mar. 10, 2026

(54) SELF-PROPELLED EARTH WORKING MACHINE HAVING A COOLANT DISCHARGE TANK

(71) Applicant: Wirtgen GmbH, Windhagen (DE)

(72) Inventors: Dieter Bungarten, Neustadt (DE); Sebastian Winkels, Windeck (DE)

(73) Assignee: Wirtgen GmbH, Windhagen (DE)

( * ) Notice: Subject to any disclaimer, the term of this patent is extended or adjusted under 35 U.S.C. 154(b) by 264 days.

(21) Appl. No.: 18/355,493

(22) Filed: Jul. 20, 2023

(65) Prior Publication Data

US 2024/0035240 A1 Feb. 1, 2024

(30) Foreign Application Priority Data

Aug. 1, 2022 (DE) ..... 10 2022 119 272.5

(51) Int. Cl.
*E01C 23/088* (2006.01)
*E01C 23/12* (2006.01)

(52) U.S. Cl.
CPC ..... *E01C 23/088* (2013.01); *E01C 23/127* (2013.01); *E01C 2301/50* (2013.01)

(58) Field of Classification Search
CPC ... E01C 23/088; E01C 23/127; E01C 2301/50
See application file for complete search history.

(56) References Cited

U.S. PATENT DOCUMENTS 3,572,841 A 3/1971 Rhodes
3,608,968 A * 9/1971 Burnett ..... B23Q 11/0046 451/352

(Continued)

FOREIGN PATENT DOCUMENTS

DE 2107161 A1 9/1971
EP 3613900 A1 2/2020

(Continued)

OTHER PUBLICATIONS

Extended Search Report for Patent Application No. 23187834.9, dated Jan. 1, 2024, 8 pages (not prior art).

*Primary Examiner* — Janine M Kreck
(74) *Attorney, Agent, or Firm* — Lucian Wayne Beavers; Patterson Intellectual Property Law, PC

(57) ABSTRACT

The present invention relates to a self-propelled earth working machine (10), comprising:

- a machine frame (16),
- a traveling gear (12) supporting the machine frame (16),
- a power source (24) for supplying the earth working machine (10) with mechanical and/or electrical and/or hydraulic power,
- a working unit (32) having a housing enclosure (30) for providing an earth working zone (E),
- a working apparatus (28) accommodated in the working unit (32), which is designed for earth working operation, and
- a liquid cooling apparatus (50), which is designed to conduct liquid coolant (C) into the working unit (32).

According to the invention, the earth working machine (10) comprises a discharge tank (58) and a discharge line system (56), the discharge line system (56) connecting the working unit to the discharge tank (58) and being designed to conduct liquid coolant (C) from the working unit (32) into the discharge tank (58).

14 Claims, 2 Drawing Sheets

(56) References Cited

U.S. PATENT DOCUMENTS

| | | | | | |
|---|---|---|---|---|---|
| 3,700,849 | A * | 10/1972 | Zuzelo | E01H 1/103 | 209/729 |
| 3,703,316 | A * | 11/1972 | Hatcher | B23D 59/02 | 404/90 |
| 3,788,704 | A | 1/1974 | Staab | | |
| 3,923,341 | A * | 12/1975 | Miller | E01C 23/088 | 299/39.2 |
| 4,561,145 | A * | 12/1985 | Latham | E01C 23/088 | 15/348 |
| 4,845,801 | A * | 7/1989 | Milly | G21F 9/001 | 15/340.1 |
| 5,441,361 | A * | 8/1995 | Campbell | E01C 23/065 | 404/90 |
| 5,564,408 | A | 10/1996 | Bassols | | |
| 8,899,870 | B1 * | 12/2014 | Hall | E01C 23/088 | 404/96 |
| 10,711,414 | B2 | 7/2020 | Verhaelen et al. | | |
| 11,401,665 | B2 | 8/2022 | Winkels et al. | | |
| 2014/0015303 | A1 * | 1/2014 | Denson | E01C 23/088 | 299/39.2 |
| 2014/0270956 | A1 | 9/2014 | Seovic | | |
| 2018/0010306 | A1 | 1/2018 | Tarmann | | |
| 2020/0063385 | A1 * | 2/2020 | Verhaelen | E01C 23/088 | |

FOREIGN PATENT DOCUMENTS

| | | | | |
|---|---|---|---|---|
| EP | 3901373 | A1 | 10/2021 | |
| FR | 3050467 | A1 * | 10/2017 | E01H 1/103 |
| GB | 2606156 | A * | 11/2022 | E01C 19/2045 |
| KR | 1020160029897 | A | 3/2016 | |
| KR | 102016945 | B1 | 9/2019 | |

* cited by examiner

SELF-PROPELLED EARTH WORKING MACHINE HAVING A COOLANT DISCHARGE TANK

RELATED APPLICATIONS

The present application claims priority to German patent application Ser. No. DE 10 2022 119 272.5 filed Aug. 1, 2022, which is incorporated herein by reference.

BACKGROUND OF THE DISCLOSURE

Field of the Disclosure

The present invention relates to a self-propelled earth working machine, which comprises:

- a machine frame,
- a traveling gear supporting the machine frame,
- a power source for supplying the earth working machine with mechanical and/or electrical and/or hydraulic power,
- a working unit having a housing enclosure for providing an earth working zone,
- a working apparatus accommodated in the working unit, which is designed for earth working operation, and
- a liquid cooling apparatus, which is designed to conduct liquid coolant into the working unit.

Description of the Prior Art

Such an earth working machine is known very generally from EP 3 901 373 A1 (U.S. Pat. No. 11,401,665) for example. This known earth working machine, the features of which may also be realized in the earth working machine of the present invention, supports a cutting drum as a working apparatus, which is used for texturing ground surfaces. The cutting drum, also called a grinding drum or grooving drum, is rotatable about a working axis running in parallel to the transverse machine direction. It comprises one or multiple cutting disks revolving about the working axis configured with geometrically defined cutters and/or with geometrically undefined cutters, for example in the form of cutting grains bonded to the cutting disks. Cutting drums of this kind may be used for example to cut grooves into a ground surface. The rotation of the cutting drum about the working axis produces the required cutting speed on the cutters situated on the cutting drum. The forward motion is produced by the travel drive via the traveling gear of the earth working machine.

A road milling machine as a further earth working machine is known from EP 3 613 900 A1 (U.S. Pat. No. 10,711,414). The known road milling machine also comprises a working apparatus rotatable about a working axis running in the transverse machine direction. The working apparatus of the road milling machine is a milling drum equipped with individual milling bits. In contrast to the cutting drum having continuously or quasi-continuously revolving cutting disks configured with cutters, the milling bits with their earth-removing bit tips are arranged in a spiral-shaped manner on the outer surface of the milling drum so as to improve the transport of the milled material produced by the earth removal. Normally, only one milling bit is situated at an axial position of the working axis of a milling drum. In road milling machines, the rotation of the milling drum about the working axis also produces the required cutting speed of the milling bit tips, while the forward motion of the milling drum is produced by the travel drive of the road milling machine.

For reasons of occupational safety and health, the working apparatus is enclosed on the working unit so that at least during an earth working operation it is not accessible from outside. The working unit may therefore comprise a housing as a housing enclosure which is open toward the ground to be worked. Such a housing is known as a milling drum box in road milling machines. A box functionally equivalent to the milling drum box, which shields a cutting drum on both sides in the transverse machine direction, on both sides in the longitudinal machine direction and in the vertical machine direction toward the machine frame, may be provided on the working unit of a ground-texturing machine.

The working unit may comprise further functional modules such as transmissions transmitting movement and power, heat exchangers, and the like.

In their normal operation, both of the mentioned types of earth-removing working apparatuses are cooled by liquid coolant, which is conducted by the liquid cooling apparatus into the working unit, in particular into the housing enclosure of the working apparatus. Normally, the liquid coolant is sprayed onto the working apparatus and/or into the area where the working apparatus engages with the earth to be removed. The liquid coolant is normally water, which is carried by the earth working machine in a reservoir.

Due to the different situation at the working engagement described above, the cutting working apparatus has a considerably higher cooling requirement than the milling working apparatus. At a lower cooling requirement, the quantity of liquid coolant fed into the working unit does not present a problem. In a milling earth removal operation at a low cutting speed, the liquid coolant at most moistens the surroundings of the working apparatus and is discharged from the working unit along with the removed coarse-grained chips. A further portion of the liquid coolant remains as moisture in the worked ground.

With an increasing cooling requirement, beginning at a specific operating point, more liquid coolant is introduced per unit of time into the working unit than can seep away in the worked ground and discharged with the removed chips. This state is amplified by two further effects:

On the one hand, the increasing cooling requirement is associated with an increasing cutting speed and consequently a greater reduction in the size of the chips produced in the earth working operation. While in a milling operation at a comparatively low cutting speed, clod-like or coarse-grained chips are quarried out of the ground surface, which can be handled as coarse bulk material, with increasing cutting speed, in particular the in transition to a cutting operation, the removed chips increasingly assume a finely grained, mealy structure and start to silt up the liquid coolant when coming into contact with it.

On the other hand, with increasing cutting speeds, not only does the volume of the individual removed chips decrease, but the removed volume or chip volume per unit of time as a whole decreases. While road milling machines are designed to remove earth material substantially in order to produce a remaining residual ground layer as a foundation for a new ground buildup, the cutting drums are merely to texture the ground surface, for example by cutting in grooves. Hence, with an increasing cooling requirement, the ability of the presently worked ground to absorb moisture or liquid often decreases.

For this reason, it is standard practice in the prior art to remove the liquid coolant actively from the earth working zone upon exceeding the aforementioned operating point with the critical cooling requirement. Due to the great quantities of liquid, used liquid coolant is transferred to a discharge vehicle, which is connected to the earth working machine by a hose line in a fluid-conducting manner. The discharge vehicle travels next to the earth working machine during the earth working operation, while used liquid coolant is transferred from the earth working machine to the discharge vehicle.

A disadvantage of this approach is on the one hand that in the event of a high cooling requirement the availability of the earth working machine depends on the availability of the discharge vehicle and that on the other hand the joint operation of the earth working machine and the discharge vehicle triggers an additional coordination requirement, for example in order to prevent the line connection established between the discharge vehicle and the earth working machine from being severed.

SUMMARY OF THE DISCLOSURE

It is therefore an object of the present invention to increase the availability of the earth working machine even in the event of a high cooling requirement at the point of engagement for the earth working operation and to avoid sources of error in the earth working operation.

The present invention achieves this object on a self-propelled earth working machine mentioned at the outset in that the earth working machine comprises a discharge tank and a discharge line system, the discharge line system connecting the working unit to the discharge tank in fluid-conducting fashion and being designed to conduct liquid coolant from the working unit into the discharge tank.

The discharge tank removes the direct dependence of the earth working machine on the availability of a discharge vehicle in operating situations with a high cooling requirement. The length of time, over which the earth working machine is able to operate with a high cooling requirement, depends on the holding capacity of the discharge tank. The discharge tank preferably has a holding capacity of at least 1,000 l (liters), particularly preferably of at least 2,000 l. Even more preferably, the holding capacity of the discharge tank is greater than 2,100 l. For reasons of stability of the machine frame and in consideration of the total weight of the earth working machine, the holding capacity of the discharge tank is preferably less than 5,000 l, particularly preferably less than 4,000 l and more preferably less than 3,000 l. In a currently constructed version, the holding capacity of the discharge tank is less than 2,500 l. The precise holding capacity for liquid coolant, however, depends not only on the outer dimensions of the discharge tank, but also on its inner structure.

The discharge line system allows for a very advantageous free choice of the location at which to mount the discharge tank on the earth working machine. This advantageously makes it possible to situate the discharge tank on the earth working machine at a distance from the working unit, so that it is possible not only to equip new earth working machines with a discharge tank, but also to retrofit existing earth working machines with a discharge tank.

The working apparatus may be or comprise a cutting drum described at the outset for texturing ground surfaces, in particular for introducing grooves into the ground surface. Additionally or alternatively, the working apparatus may be or comprise a milling drum described at the outset. What was said above about the known earth working machine equipped with a cutting drum and about the known road milling machine applies to the cutting drum or milling drum and the earth working machine of the present invention equipped with these.

As in the prior art, the liquid coolant for the earth working machine of the present invention is preferably water.

In principle, it is conceivable to situate a discharge transfer pump in the discharge line system in order to provide the necessary pressure drop in the discharge line system for the controlled conveyance of liquid coolant from the working unit to the discharge tank. According to a preferred development of the present invention, the discharge tank additionally or preferably alternatively has a vacuum apparatus, which is designed to remove gas from the discharge tank. This vacuum apparatus can be used to generate an underpressure, which provides the pressure drop required for transferring liquid coolant from the working unit to the discharge tank. The gas is normally air. It shall not be precluded, however, that an atmosphere different than air is produced in the gas-filled space above the liquid coolant in the discharge tank, for example in order to impede the growth of aerobic microbes.

The vacuum apparatus is preferably designed to produce a pressure in the gas-filled space in the interior of the discharge tank that is at least 18 hPa lower than the ambient pressure outside of the discharge tank, preferably at least 22 hPa lower, even more preferably at least 24 hPa lower. An underpressure in the discharge tank compared to the ambient pressure with a pressure difference of −40 hPa should suffice in preferred specific embodiments to transfer even large quantities of liquid coolant per unit of time over long line paths from the working unit to the discharge tank. A pressure difference compared to the ambient pressure of −34 hPa is reliably able to transfer slightly above-average quantities of liquid coolant per unit of time. With a view to avoiding unnecessary investments in vacuum apparatuses, the price of which increases with their maximally possible vacuum power, an underpressure compared to the ambient pressure with a pressure difference of −27 hPa may suffice for most earth working applications. The vacuum apparatus is therefore preferably designed in such a way that it produces a pressure in the discharge tank that is lower than the ambient pressure by no more than 40 hPa, particularly preferably by no more than 34 hPa, even more preferably by no more than 27 hPa.

The vacuum apparatus may comprise at least one ventilator, preferably a plurality of ventilators, in order to remove gas, in particular air, from the discharge tank. Preferably, a ventilator system having one or multiple ventilators is situated on a—when looking at the operational earth working machine—top side of the discharge tank, so that during an earth working operation it is reached as late as possible or preferably not reached at all by the liquid coolant level rising in the discharge tank. The top side of the discharge tank is therefore preferably formed by a plane wall or by a wall that is convex when looking at the top side of the discharge tank from outside and thus concave when looking at the top side of the discharge tank from inside, the plane or curved wall supporting the vacuum apparatus, in particular its ventilator system.

In order to achieve a sufficient relative underpressure in the discharge tank compared to the ambient atmosphere, the ventilator system as a whole may have a conveying capacity during earth working operation of at least 10,000 $m^3/h$ at a standard air atmosphere of 20° C. and 1013 h Pa. More preferably, the conveying capacity of the ventilator system during earth working operation is at least 13,000 $m^3/h$, even more preferably at least 16,000 $m^3/h$, respectively at the mentioned standard air atmosphere as test atmosphere.

In order to avoid excessive energy consumption and excessive installation space requirement, the ventilator system is preferably designed for a conveying capacity during earth working operation of no more than 30,000 $m^3/h$ at the standard air atmosphere. More preferably, the conveying capacity of the ventilator system during earth working operation is no more than 24,000 $m^3/h$, even more preferably no more than 19,000 $m^3/h$, respectively at the mentioned standard air atmosphere as test atmosphere. The ventilator system is preferably designed in accordance with the upper performance requirements. For example, the ventilator system may have corresponding nominal conveying capacities.

In the preferred case, where the ventilator system comprises a plurality of ventilators, the nominal conveying capacities of air conveyed per hour at standard air atmosphere differ by no more than 15%, preferably by no more than 10%, relative to the greater of two compared nominal conveying capacities. Particularly preferably, the ventilators of a ventilator system are designed with the same nominal conveying capacity. Most preferably, only identical ventilators are combined to form a ventilator system of the vacuum apparatus.

As was already described above, the presently discussed operating case with a high cooling requirement occurs at high cutting speeds and low chip volume, which increases the tendency of the used liquid coolant to silt with fine-grained chip material suspended in the liquid coolant. In order to prevent chip material suspended in the liquid coolant from settling in the discharge tank, the discharge tank may comprise a motion apparatus, which is designed to set and/or keep liquid coolant collected in the discharge tank in motion. The motion apparatus may be a splash device, which in reciprocating fashion moves a splash blade back and forth in the interior volume of the discharge tank. The motion apparatus is preferably a stirring apparatus, which by a rotating motion of a stirring tool is designed to stir liquid coolant collected in the discharge tank. The movement space of a stirring tool is smaller than that of a splash blade, and at an identical quantity of liquid in the discharge tank, eddies in the discharge tank often require the absorption of lesser bearing forces than splash motions.

In principle, it is conceivable to design the discharge tank using a vat and a removable cover covering the vat. The vat preferably surrounds the major part of the receiving volume of the tank. The cover preferably supports the vacuum apparatus and comprises the aforementioned plane or curved upper tank wall. When the nominal filling capacity of the discharge tank is reached, it is in principle conceivable to detach the full vat from the cover and, if indicated, from the machine frame and to exchange it for an empty vat. However, this requires further machine use on the construction site.

For discharging the discharge tank, the earth working machine may have a transfer pump, which is designed to transfer liquid coolant collected in the discharge tank from the discharge tank. The transfer pump can then transfer the liquid coolant from the discharge tank into a further tank, which may be mounted on a trailer for example and may be towed by the earth working machine as the towing vehicle or which may be pushed by the earth working machine. The transfer pump may also transfer liquid coolant from the discharge tank into a tank of a discharge vehicle, with which the operating personnel at the construction sites is already familiar. The advantage still persists that the discharge vehicle is required only temporarily and that its use may be scheduled and shifted within certain temporal limits without loss of the availability of the earth working machine.

For the conveyance of liquid, the transfer pump is preferably designed with a conveying capacity that allows for a conveyance per hour of more than the holding capacity of the discharge tank. The conveying capacity of the transfer pump preferably is at least 3,200 l/h, particularly preferably at least 3,500 l/h and even more preferably at least 3,800 l/h. For reasons of economy with a view to a maximally possible holding capacity of the discharge tank, the conveyance capacity of the transfer pump is preferably no more than 6,000 l/h, more preferably no more than 5,000 l/h and even more preferably no more than 4,200 l/h.

In order to clean the used and therefore soiled liquid coolant and thus to facilitate its further processing or disposal, the earth working machine may comprise a filter apparatus, which is designed to filter particles, in particular chip material of the removing earth working operation, which are suspended in the liquid coolant collected in the discharge tank, out of the liquid coolant. This makes it possible to reduce the portion of particles suspended in the liquid coolant considerably.

So as not to impede a discharge of the liquid coolant from the working unit, it is preferred to situate the filter apparatus in the conveyance line of the transfer pump so that liquid coolant flows through the filter apparatus when, in particular only when, the transfer pump is in operation in order to transfer liquid coolant out of the discharge tank. The filter apparatus may be accommodated in the discharge tank, which is less preferable, however, due to the associated loss of storage volume for receiving liquid coolant and the associated effort for exchanging or cleaning filter elements. The filter apparatus may be accommodated on the outer side of the discharge tank to ensure that together with the discharge tank, the filter apparatus is also always carried along with the earth working machine. As a further alternative, the filter apparatus may be situated on a supporting frame firmly connected to the discharge tank, but at a distance from the tank wall so as to provide the filter apparatus in a manner that is accessible from as many sides as possible. The filter apparatus may also be accommodated on the machine frame at a distance from the discharge tank.

The earth working machine usually has a reservoir in order to provide liquid coolant for use to the liquid cooling apparatus. This reservoir preferably has a holding capacity of at least 2,900 l, more preferably of at least 3,200 l and even more preferably of at least 3,400 l. Considering the cooling requirement on the one hand and the total weight of the earth working machine, the holding capacity of the reservoir is preferably not greater than 6,000 l, particularly preferably not greater than 4,500 l and even more preferably not greater than 3,700 l. Further preferably, the holding capacity of the reservoir is greater than the holding capacity of the discharge tank, so that starting from an onset of the operation with a completely filled reservoir and a completely emptied discharge tank, the discharge tank forms the operation-limiting component with regard to the required cooling. Ultimately, it is easier to empty a full tank than to have to fill an empty tank.

Freed of the requirement of a discharge vehicle, the operating time of the earth working machine can be extended further in that a return line connects the discharge tank to the reservoir by interposition of the filter apparatus and the transfer pump. This makes it possible for the transfer pump to transfer filtered liquid coolant, that is, preferably water, from the discharge tank back into the reservoir, from where the liquid coolant can be fed again to the working unit. The filter apparatus may be situated on the suction side or on the pump side or as a split filter apparatus on both sides of the transfer pump. Preferably, the filter apparatus is situated on the suction side of the transfer pump so that liquid coolant flowing through the transfer pump has already been cleaned and thus in operation puts less abrasive stress on the transfer pump.

To avoid damage and excessive noise generation when soiled liquid coolant rushes into the discharge tank, according to a preferred development, a baffle is situated in the discharge tank downstream from an inlet of the discharge line system into the discharge tank and preferably at a distance from the inlet. The baffle may be a rigid body such as a plate or a shield made of metal or ceramic, for example. In a preferred specific embodiment, the baffle may comprise elastic, for example elastomeric, planar bodies such as a plate or a lip made of, preferably reinforced, rubber or silicone rubber or another elastomer, for example. When liquid coolant is transferred through the discharge line system into the discharge tank, the liquid coolant emerging from the discharge line system strikes the baffle.

The inlet of the discharge line system into the discharge tank is preferably in the upper half of the discharge tank, when looking at it in the operational state, particularly preferably in the upper quarter of the discharge tank, so that the vacuum apparatus is able to transfer liquid coolant from the working unit into the discharge tank over the longest possible operating time without the counteraction of a back pressure from a liquid volume rising in the discharge tank.

The earth working machine may comprise a connection formation in fluid communication with the discharge tank for temporary connection of a fluid line, for example for connecting a fluid line leading to a discharge vehicle. This makes it possible to withdraw liquid coolant from the discharge tank, preferably while the latter is situated on the earth working machine and particularly preferably during an earth working operation, in order to increase again the storage capacity of the discharge tank in the respective situation.

The connection formation may be formed directly in the tank wall or permanently connected to the tank wall as a connection fitting or at the longitudinal end, remote from the tank, of a flexible line connected to the discharge tank, which makes it possible to eliminate the need for lines between the discharge tank and the connection formation or at least to keep these short. In addition, for example if the transfer pump is accommodated in the interior of the discharge tank, or alternatively, the connection formation may be situated or formed on the transfer pump or on a longitudinal end, remote from the pump, of a pressure-side transfer line of the transfer pump. It is thus possible to provide the connection formation at nearly any location on the earth working machine. In addition, on the side of the earth working machine, the transfer pump is always able to transfer liquid coolant out of the discharge tank, regardless of the structure or equipment of the transfer target of the transfer pump. The connection formation may be connected to the discharge tank by interposition preferably of the aforementioned filter system.

The transfer pump and/or the filter system and/or the connection formation may be accommodated on the aforementioned supporting frame connected to the tank wall.

The presently discussed earth working machine may be any self-propelled earth working machine having a cooling requirement. Preferably, as explained in detail above, the machine is an earth-removing earth working machine. The working apparatus is then preferably a removal apparatus rotatable about a working axis such as the cutting drum or milling drum described above. The working axis normally runs in the transverse machine direction, that is, in parallel to the pitch axis of the self-propelled earth working machine.

The earth working machine is preferably retoolable between for example a working unit having a first earth working function and a further working unit having a second earth working function distinct from the first. A working unit may be for example a cutting unit having a cutting drum for texturing cutting work on a ground surface as a first earth working function. A further working unit may be for example a milling unit having a milling drum for removing entire earth layers from the ground surface as a second earth working function.

Additionally or alternatively, the earth working machine may be retoolable between a working unit requiring maintenance and an operationally ready working unit, each having the same earth working function.

The working unit is therefore preferably a swappable working unit designed to be detachable from the machine frame. As a swappable working unit, the working unit thus preferably has coupling formations for coupling with mating coupling formations on the machine frame. A coupling formation on the swappable unit and a mating coupling formation on the machine frame cooperating with the coupling formation may be in each case a fastening lug having mutually facing lug surfaces, which are designed to abut against each other. The lug surfaces are preferably plane lug surfaces. For fixing the fastening lugs to each other, at least one of the fastening lugs has a through hole. The other fastening lug may then have a fastening projection penetrating through the through hole when an abutting engagement of the lug surfaces is established. The fastening projection may comprise a threaded rod designed to clamp the fastening lug having the through hole between the fastening lug bearing the fastening projection and a fastening nut that is screwed onto the threaded rod. Alternatively, each of the two fastening lugs may have a through hole, which align with each other when an abutting engagement of the lug surfaces is established, so that the aligned through holes may be connected to each other by a fastening screw and a fastening nut or by a set screw having a fastening nut on each side of the fastening lugs.

Alternatively, the aforementioned fastening projection may be movable hydraulically or pneumatically between a locked position engaging behind the fastening lug having the through hole and a release position disengaging the fastening lug having the through hole for separation from the fasting lug having the fastening projection.

A, possibly additional, coupling formation may comprise a centering body, and a mating coupling formation cooperating with the coupling formation may comprise a centering recess, for example a centering cone or a centering spherical cup as a centering body and a negative-conical centering recess. Such centering coupling formations and mating coupling formations make it possible to ensure quickly and securely that the machine frame and the swappable working unit are in a predetermined relative position and orientation to each other immediately prior to fixing the swappable working unit on the machine frame.

If the machine frame of the presently discussed earth working machine is designed for accommodating a working unit having a milling drum, the machine frame preferably comprises a conveyor belt holding fixture for releasably accommodating a conveyor belt for transporting removed earth material away from the location of the working unit.

This applies to an earth working machine that is designed permanently as a road milling machine. This applies in particular, however, to an earth working machine that, owing to coupling interfaces on the machine frame, can be equipped alternatively with a milling unit or with a cutting unit. Although the cutting unit normally does not require a conveyor belt with the transport capacity of a conveyor belt for a road milling machine, the conveyor belt holding fixture is nevertheless extremely advantageous in the event that the earth working machine is tooled as a road milling machine.

Due to the releasable arrangement of the conveyor belt on the machine frame, the discharge tank may be releasably situated on the conveyor belt holding fixture in the event that the earth working machine is retooled for an earth working operation with a high cooling requirement, for texturing cutting work for example.

In the present application, the term "releasable" means intended to be releasable, i.e., the respective component, in this case the conveyor belt and the discharge tank, can be quickly detached from and reattached to the rest of the earth working machine by fastening means intended to be releasable in non-destructive and isolated fashion and without prior disassembly of further components of the earth working machine.

As a road milling machine, the earth working machine is preferably a front loader road milling machine, which transports milled material in the travel direction to or beyond the longitudinal front end of the earth working machine in order to discharge for example milled material into a transport vehicle traveling ahead of the earth working machine. Such front loader road milling machines are designed for high removal volumes per unit of time and accordingly have a sturdy conveyor belt holding fixture. The conveyor belt holding fixture may comprise for example at least one bolt running in the vertical machine direction or preferably at least two bolts arranged coaxially in the vertical machine direction, on which it is possible to fasten not only the conveyor belt, but also the discharge tank. In order to make the at least one bolt easier to reach, the at least one bolt may be situated on a retaining bracket rigidly connected to the machine frame and protruding from the machine frame in the longitudinal machine direction. When using more than one bolt, each bolt is preferably situated on one such retaining bracket.

To facilitate fastening the discharge tank on the machine frame, the earth working machine comprises a support bracket formed separately of the machine frame, which can be hinged on the conveyor belt holding fixture, for example by sliding at least one fastening eye or fastening bushing onto the at least one bolt of the conveyor belt holding fixture. Since the conveyor belt holding fixture preferably has at least two, particularly preferably exactly two coaxially arranged bolts, which respectively project in the same vertical machine direction from the retaining bracket that supports them, the support bracket preferably also has at least two, particularly preferably exactly two, coaxially arranged fastening eyes or fastening bushings in order to be able to brace a turning moment about a turning axis that is parallel to the vertical machine direction on the machine frame.

In a kinematic reversal, the at least one bolt may be situated on at least one retaining bracket of the support bracket and the at least one fastening eye or fastening bushing may be situated rigidly on the machine frame. A bolt projecting on a retaining bracket of the support bracket projects from its retaining bracket in the opposite direction as a bolt fixed on the machine frame so as to ensure that it can be hinged on the fastening eye or fastening bushing.

The support bracket is preferably a component connected to the discharge tank in movable fashion relative to the discharge tank so that the discharge tank coupled to the machine frame of the earth working machine is able to perform movements relative to the machine frame, for example in order to be able to adjust the discharge tank relative to the machine frame or in order to allow evading movements in the event that there is great quantity of strongly swashing liquid coolant in the discharge tank.

A further advantage is the separate producibility of the support bracket, which may be connected alternatively to a conveyor belt or to the discharge tank. Preferably, a conveyor belt added to the earth working machine as part of the equipment as a road milling machine has its own support bracket and the discharge tank as part of the equipment for texturing the ground has its own identical support bracket.

As an alternative to assigning a separate support bracket to a conveyor belt and to a discharge tank, the support bracket may be permanently connected to the conveyor belt holding fixture on the machine frame and be developed on a coupling engagement formation situated at a distance from the conveyor belt holding fixture for coupling with a mating coupling engagement formation on the discharge tank. The discharge tank preferably has an identical mating coupling engagement formation as the conveyor belt so that one and the same support bracket is able to support both the conveyor belt as well as the discharge tank.

A formation made up of coupling engagement formation and mating coupling engagement formation, preferably the mating coupling engagement formation of the discharge tank, comprises or is identical to coaxial pins situated at a distance from one another and projecting in opposite directions. The coaxial arrangement of the pins makes it possible to achieve an inclinability of the discharge tank relative to the support bracket. By arranging the pins at a distance from one another, it is possible to brace a tilting moment orthogonal to the axis of inclination of the discharge tank relative to the support bracket.

If the pins are situated on the discharge tank as the mating coupling engagement formation, they preferably protrude from the discharge tank in opposite directions away from each other on different sides of the discharge tank. If the pins are situated on the support bracket, they preferably protrude from sections of the support bracket toward each another.

The respective other formation of the coupling engagement formation and the mating coupling engagement formation, which is not a pin, preferably comprises for each pin an associated encompassing section having an insertion opening through which the pin can be inserted into the encompassing section. The encompassing section encompasses the pin inserted into it along a circumferential section, for instance of 180°, so that the pin is accommodated in the encompassing section in a form-locking manner. Particularly preferably, for the purpose of increasing operational safety, the insertion opening is closable, for example by a displaceable closure component, which is displaceable between a locked position, in which it physically blocks the insertion opening, and a release position, in which the pin can be inserted into the encompassing section through the insertion opening and can be removed from the encompassing section. To reduce the operational effort of the machine operator controlling the earth working machine, the closure component may be designed as a catch preloaded into the locked position, which can be displaced from the locked position into the release position by the pin only when inserting the pin into the encompassing section and which, when the pin is inserted in the encompassing section, must be actively displaced into the release position in order to allow for the pin to be released from the encompassing section.

The supporting frame preferably comprises a retaining fork, which retains the discharge tank between its parallel fork legs in the operational state of the discharge tank.

Irrespective of the concrete attachment of the discharge tank on the machine frame, the discharge tank is preferably inclinable relative to the machine frame about an axis of inclination that is parallel to the contact area of the earth working machine, be it in order to adjust the discharge tank relative to the machine frame or be it for the purpose of the aforementioned evading movements. Additionally or alternatively, it is even conceivable that the discharge tank, like the conveyor belt, is situated so as to be swivable about a swivel axis that is parallel to the yaw axis of the earth working machine. This would make it possible to adjust the orientation of the discharge tank relative to an accompanying discharge vehicle to the equipment of the discharge vehicle or to the respective prevailing operating situation.

The earth working machine may have an inclination actuator in order to drive the discharge tank to perform an inclining movement. Such an inclination actuator may be operable in hydraulic or pneumatic or electric fashion. It may be a piston-cylinder system or a spindle drive. The inclination actuator may also be operable manually, for example as a turnbuckle spindle drive.

Additionally or alternatively, the earth working machine may comprise an inclination damper in order to dampen an inclination movement of the discharge tank. This may be necessary in order to dampen swashing movements of larger quantities of liquid collected in the discharge tank and movements of the discharge tank itself resulting therefrom.

In the event that the discharge tank is swivable about the yaw axis or vertical machine axis, the earth working machine may comprise a swivel actuator in order to drive the discharge tank to perform a swiveling movement, and/or the earth working machine may comprise a swivel damper in order to dampen a swiveling movement of the discharge tank. The swivel actuator may be constructed in similar fashion as the inclination actuator.

The traveling gear may comprise at least three drive units rollable on a contact area of the earth working machine. The drive units may be wheel drive units or crawler track drive units. At least one of the drive units is preferably steerable. Particularly preferably, drive units of a common axle are steerable, and preferably by adhering to the Ackermann condition.

The working apparatus—when viewing the earth working machine in straight-ahead travel—is preferably accommodated in a longitudinal area of the earth working machine, which extends in straight-ahead travel of the earth working machine from the front end of the front-most drive unit to the rear end of the rear-most drive unit. Particularly preferably, the working apparatus—when viewing the earth working machine in straight-ahead travel—is situated in a longitudinal area between the rear-most end of the front-most drive unit and the front-most end of the rear-most drive unit. For example, the earth working machine may comprise two drive units forming a front axle and two drive units forming a rear axle, the working apparatus being preferably situated in the longitudinal machine direction between the front drive units and the rear drive units.

For the purpose of facilitating a connection to an accompanying discharge vehicle, the discharge tank is preferably situated running ahead of the machine frame in forward travel. In this preferred case, at least 50%, particularly preferably at least 65%, even more preferably at least 80% of the holding capacity of the discharge tank are located in front of the front axle of the earth working machine.

The drive units of the front axle are then preferably located in the longitudinal machine direction between the discharge tank and the working unit.

The power source of the earth working machine, which may be an internal combustion engine, in particular a diesel engine, or even an electric motor, is preferably situated in the longitudinal machine direction closer to the rear axle than to the front axle, particularly preferably on the other side of the working apparatus as the discharge tank, in order to provide a counterweight to the discharge tank. To achieve the most uniform weight distribution possible along the longitudinal machine axis, the aforementioned reservoir is preferably situated in the longitudinal machine direction closer to the front axle than to the rear axle. An operator's platform, on which the machine operator is located during the operation of the earth working machine in order to operate the earth working machine, is preferably situated in the longitudinal machine direction between the reservoir and the power source.

Via a rotating shaft, the power source is able to output mechanical power, which may be converted into hydraulic and/or electrical power by connecting a hydraulic pump and/or a generator. The mechanical power may also be used directly on the earth working machine, for example for driving the working apparatus to rotate about the working axis. A transfer gear makes it possible to use the mechanical power output on a rotating shaft both without conversion of the type of power as mechanical power as well as with conversion into hydraulic power and/or electrical power.

BRIEF DESCRIPTION OF THE DRAWINGS

The present invention will be explained in greater detail below with reference to the enclosed drawings. The figures show.

DETAILED DESCRIPTION

Figure 1:
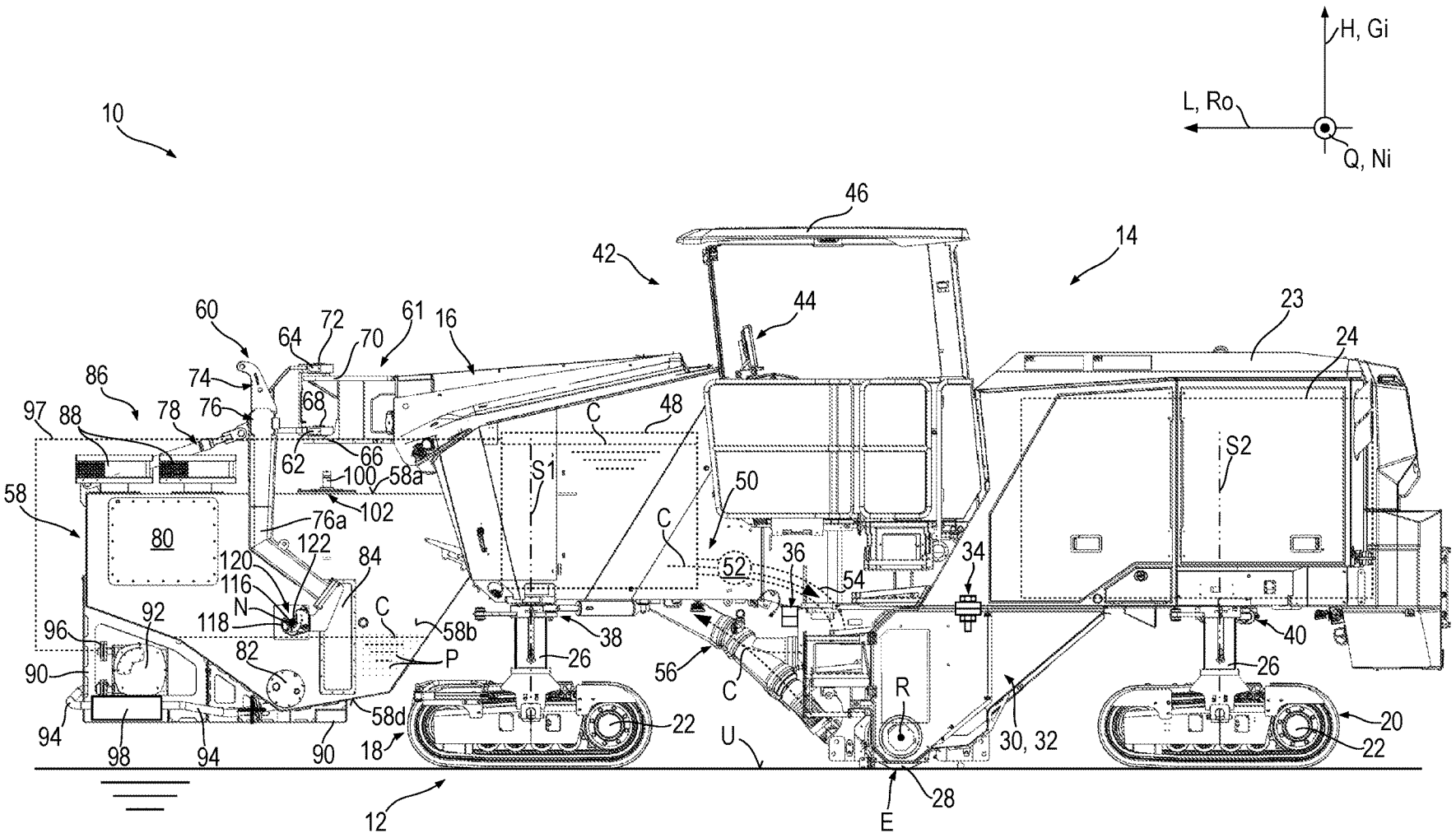
FIG. 1 a rough schematic side view of a specific embodiment according to the invention of an earth working machine, equipped for texturing cutting work on a ground surface, and FIG. 2 a rough schematic perspective view of the discharge tank from FIG. 1 without the side wall, coupled to a discharge line system that discharges liquid coolant on both sides of a working apparatus.
Figure 2:
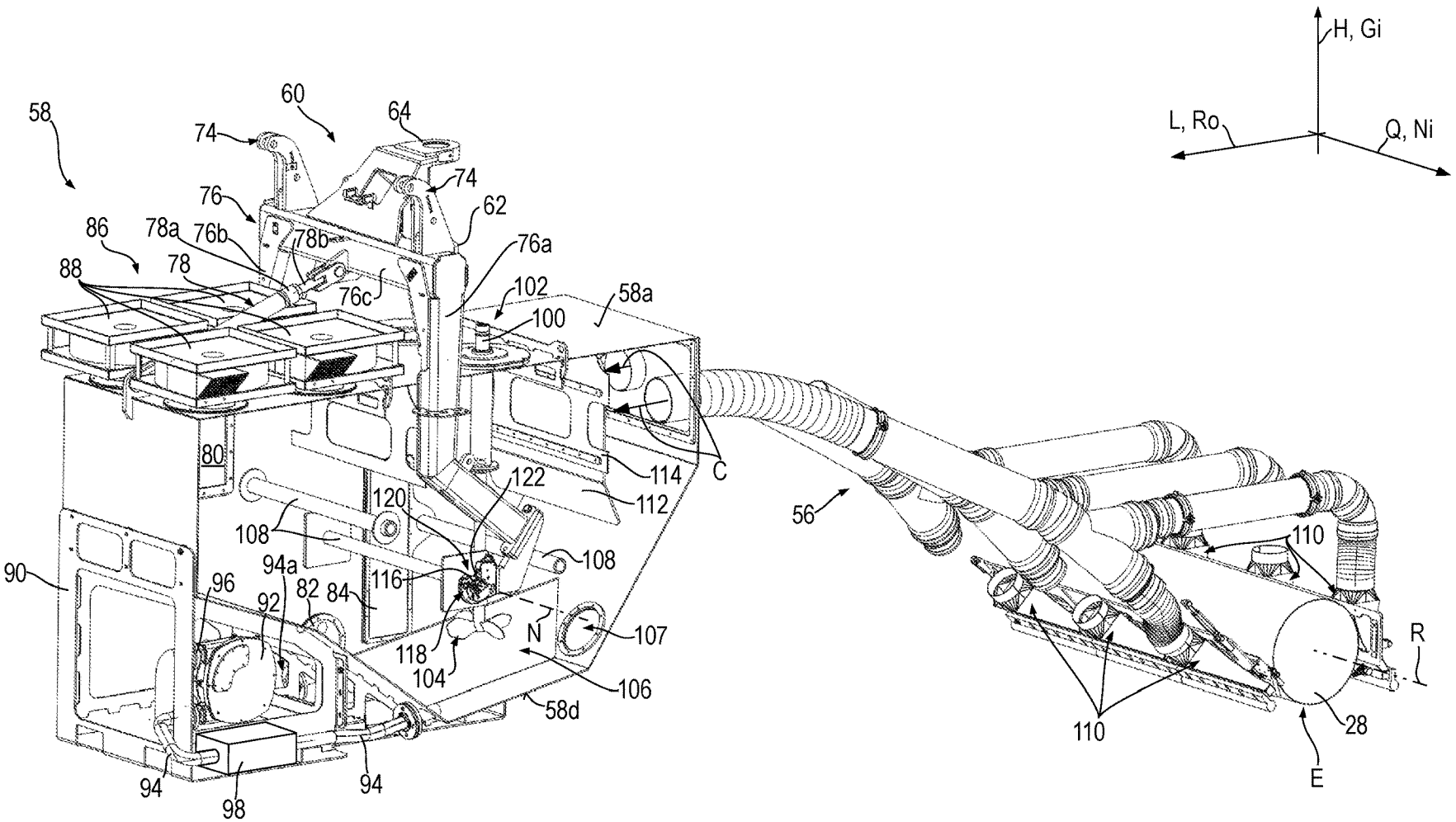

In FIG. 1, a specific embodiment according to the invention of an earth working machine of the present application is generally denoted by reference numeral 10. The earth working machine 10 is illustrated in a side view. FIGS. 1 and 2 show a Cartesian coordinate system typical for self-propelled vehicles made up of a roll axis Ro running along the longitudinal machine axis L, a yaw axis Gi running along the vertical machine direction H, and a pitch axis Ni running along the transverse machine direction Q. The arrow in the longitudinal machine direction L points in the forward travel direction.

The earth working machine 10 or hereinafter simply "machine" 10 comprises a machine body 14 supported by a traveling gear 12. The machine body 14 comprises a rigid machine frame 16 and components and modules arranged thereon, which are in part movable relative to the machine frame 16, such as doors and hatches as well as the protective canopy 46 and the like.

In the illustrated example, the traveling gear 12 comprises two front crawler track units 18, of which only the left crawler track unit 18 situated closer to the viewer of FIG. 1 is seen, which conceals the right crawler track unit situated behind it, and two rear crawler track units 20. In place of the crawler track units 18 and 20, it is also possible to use wheel drive units.

Each crawler track unit 18 and 20 has its own hydraulic motor 22 as the travel drive. A power source 24 situated in the area of the rear end of the earth working machine 10 on the machine frame 16 below a cover 23, which is therefore indicated by a dashed line, and which in the illustrated exemplary embodiment has the form of a diesel-operated internal combustion engine, provides the power necessary for operating the earth working machine 10. Power is transmitted from its crankshaft via a transfer gear (not shown) to a hydraulic pump, which generates and maintains a hydraulic pressure required for the travel drive and for other hydraulic consumers on the earth working machine 10.

Via hydraulically operated lifting columns 26, the machine frame 16 and with it the machine body 14 is displaceable in the vertical machine direction H relative to the contact area U, on which the earth working machine 10 stands via its traveling gear 12. In the preferred case of a working apparatus 28 that is situated on the machine frame 16 so as to be non-displaceable in the vertical machine direction H, an engagement depth of the working apparatus 28 into the contact area U for the purpose of working the latter can be set by displacing the machine frame 16 in the vertical machine direction H. It is in principle also possible, however, to situate the working apparatus 28 on the machine frame 16 so as to be displaceable relative to the latter in the vertical machine direction H and to set the engagement depth by relative displacement of the working apparatus 28 on machine frame 16. Reference character E indicates an engagement zone of the working apparatus 28 into the contact area U.

The working apparatus 28, in the illustrated exemplary embodiment a cutting drum drivable to rotate about a working axis R running in the transverse machine direction Q for working the surface of the contact area U in grooving-texturing fashion, is accommodated in a box 30 shielding the working apparatus on both sides in the longitudinal machine direction L and on both sides in the transverse machine direction Q as well as toward machine frame 16 in the vertical machine direction H. The box 30 is part of a swappable working unit 32, which is releasably accommodated on machine frame 16 via predetermined mechanical interfaces 34 and energy supply interfaces 36 for transmitting hydraulic and/or pneumatic and/or electrical energy, and which is exchangeable in a comparatively short time against another working unit.

The earth working machine 10 illustrated in FIG. 1, at any rate its machine body 14 with the traveling gear 12 supporting it via lifting columns 26, may be retooled to a road milling machine by exchanging the illustrated working unit 32 for grooving-texturing cutting work against a milling unit for milling work on the working ground.

Rotating the working apparatus 28 about its working axis produces the necessary cutting speed on the respective cutting circle of the working apparatus 28. The travel drive with the hydraulic motors 22 provides the forward motion of the working apparatus 28. In the illustrated exemplary embodiment, the front drive units 18 are steerable by a front Ackermann steering apparatus 38 about front steering axes S1 and the rear drive units 20 are steerable by a rear Ackermann steering apparatus 40 about rear steering axes S2.

The operation of the earth working machine 10 is controlled from an operator's platform 42, on which the machine operator is located during the earth working operation or also during a travel operation of machine 10. At least one control panel 44 is situated on the operator's platform 42 for outputting information and for inputting control commands. The operator's platform 42 is also protected against the effects of weather by the already mentioned lowerable protective canopy 46.

The working apparatus 28 must be cooled during an earth working operation. For this purpose, the earth working machine 10 carries along a reservoir 48 situated in front of the operator's platform 42, which is able to take up approximately 3,500 l of water as the preferred liquid coolant C.

The reservoir 48 is part of a liquid cooling apparatus 50, which feeds liquid coolant C from the reservoir 48 into the working unit 32 via a liquid coolant line 54 using a liquid coolant pump 52. The cooling apparatus 50 may also be referred to as a liquid coolant supply 50.

The cooling requirement in the cutting or grooving engagement of the working apparatus 28 in the form of a cutting drum is high. It amounts to approximately 3,000 to 3,500 l/h. This quantity of liquid coolant C cannot be permanently fed into the working unit 32 without actively discharging liquid coolant C from the working unit 32.

For this purpose, the earth working machine 10 comprises a discharge line system 56, which is designed to discharge liquid coolant C from the working unit 32. In addition, a discharge tank 58 is accommodated on the earth working machine 10, into which the liquid coolant C discharged by the discharge line system 56 is fed. In FIG. 1, dots P indicate particles P, for example removed chips, which are suspended in the discharged liquid coolant C.

A portion of the discharge line system 56 that is concealed in FIG. 1 by the machine body 14 runs in a shaft of the machine body 14, through which, when the earth working machine 10 is tooled as a road milling machine, a conveyor belt runs in order to transfer milled material away from the working unit to the front end of the earth working machine 10. The discharge line system 56 is preferably situated on the machine frame 16 so as to be detachable entirely or partially and is designed to be exchangeable together with the discharge tank 58 against a conveyor belt.

The discharge tank 58 is connected to the machine frame 16 via a support bracket 60. An identical support bracket 60 is also used in the event that the earth working machine 10 is tooled as a road milling machine, in order to connect the aforementioned conveyor belt to the machine frame 16.

The support bracket 60 is accommodated on a conveyor belt holding fixture 61 of the earth working machine 10. The support bracket 60 (see also FIG. 2) is connected via a lower fastening eye 62 and an upper fastening eye 64 to a bolt 68 projecting upward from a lower retaining bracket 66 and to a coaxial bolt 72 projecting upward from an upper retaining bracket 70. The retaining brackets 66 and 70 together with their respective coaxially projecting bolts 68 and 72 form the conveyor belt holding fixture 61.

The support bracket 60 is lowered with its fastening eyes 62 and 64 from above along the vertical machine direction to the retaining brackets 66 and 70, so that the lower bolt 68 engages into the lower fastening eye 62 and the upper bolt 72 engages into the upper fastening eye 64. The retaining brackets 66 and 70 project forward in the longitudinal machine direction L.

Draw bearing stringers 74 of the support bracket 60, which accommodate the ends of draw rods or draw cables in the event that the support bracket 60 is coupled to a conveyor belt, are present on account of the fact that the support bracket 60 can also be used to accommodate conveyor belts but are without function in the event of a coupling to the discharge tank 58.

The support bracket 60 comprises a retaining fork 76, between the parallel angled legs 76*a* and 76*b* of which the discharge tank 58 is connected to the longitudinal end of the retaining fork 76 so as to be inclinable about an axis of inclination N in parallel to the transverse machine direction Q. It is possible to adjust the inclination of the discharge tank 58 relative to the machine frame 16 within predetermined limits via a manual actuator 78 in the exemplary form of a turnbuckle, that is, basically a screw drive, which connects a cross bar 76*c* (see FIG. 2) of the retaining fork 76 with an upper wall 58*a* of the discharge tank 58.

The coupling of the discharge tank 58 to the retaining fork 76 is explained in detail at the end of the description of the exemplary embodiment.

On the side wall 58*b* of the discharge tank 58 facing the viewer in FIG. 1, a maintenance access covered by a maintenance cover 80 can be seen in the upper left area. The maintenance access is dimensioned in such a way that a person is able to climb through it.

At a location near the lowest point of the bottom 58*d* of the discharge tank 58, a cleanout opening is covered by a cover 82 that is circular by way of example. Particle material P deposited on the bottom 58*d* of the discharge tank 58 may be removed from the discharge tank 58 through the cleanout opening during maintenance work. The used liquid coolant C fed into the discharge tank 58 is normally a suspension of liquid coolant and fine-grained chips removed during the earth working operation, so that there is a concrete need for cleaning the bottom area.

The bottom 58*d* of the discharge tank 58 is advantageously inclined relative to the direction of the gravitational force parallel to the vertical machine direction, so that a downgrade force acts on particles P settling on the bottom 58*d*, which causes deposited particles P to collect at the lowest point of the discharge tank 58. In the illustrated exemplary embodiment, the bottom 58*d* is advantageously formed, in terms of production engineering, from multiple plane sheets that are inclined relative to one another. This is merely an exemplary embodiment, however. The bottom may likewise be designed to be curved about an axis of curvature or about two orthogonal axes of curvature. A plane bottom, which is oriented orthogonally with respect to the direction of gravitational force is in principle possible as well.

An inspection glass 84, which is advantageously formed of plastic, for example of polymethacrylate, and the dimension of which along the direction of the force of gravity is advantageously greater than crosswise, makes it possible visually to check the fill level of the discharge tank.

In the illustrated exemplary embodiment, a vacuum apparatus 86 is situated on the upper wall 58*a* at the front longitudinal end of the discharge tank 58, which comprises four identical ventilators 88 in the exemplary embodiment (see FIG. 2). Using the vacuum apparatus 86, air can be removed from the discharge tank 58 so that a relative underpressure compared to the pressure prevailing in the working unit 32 can be produced and maintained in the discharge tank 58.

Driven by this relative underpressure, cooling liquid C flows from the working unit 32 via the discharge line system 56 into the discharge tank 58. Thus, the discharge line system 56 preferably has no need for a discharge transfer pump, although it is not to be precluded that the transfer of used liquid coolant C from the working unit 32 into the discharge tank 58 may be supported by a discharge transfer pump or may be even effected by it alone.

In the exemplary embodiment, a supporting frame 90 is attached, for example welded, screwed or riveted, on the outside in the front lower area of the storage tank. The discharge tank 58 is preferably made of metal, in particular of sheet metal. A transfer pump 92 is situated on supporting frame 90, which on the suction side removes liquid coolant from the discharge tank 58 via a transfer line 94 and on its pressure side transfers this liquid coolant to a discharge point that is not illustrated in the figures. A pressure-side flange 96 is a connection formation for connecting an extending transfer line, for example to a discharge vehicle. A return line 97 is indicated only symbolically by a dashed line, via which the transfer pump 92 is able to transfer liquid coolant C from the discharge tank 58 back into the reservoir 48.

Between the discharge tank 58 and the transfer pump 92, a merely symbolically illustrated filter apparatus 98 is situated in the transfer line 94, which is designed to filter out particles P suspended in the liquid coolant C, so that the liquid coolant C flowing through the transfer pump 92 already has a clearly reduced dirt load compared to the liquid coolant C directly removed from the discharge tank 58. This not only reduces the load of abrasive wear on the transfer pump 92, but additionally allows for the return of liquid coolant C back into the reservoir 48 through the return line 97, possibly by interposition of a further filter apparatus between the transfer pump 92 and the reservoir 48, for example for micro-filtration in order to remove even smaller particles P from the liquid coolant C than filter apparatus 98 is able to remove.

Furthermore, FIG. 1 shows a shaft end 100 of a stirring apparatus 102 protruding from the upper tank wall 58*a*, the stirring apparatus 102 being used to keep the liquid coolant C collected in the discharge tank 58 in motion in order at least to delay removed chips suspended in the liquid coolant C from settling. The stirring apparatus 102 may also be referred to as an agitator 102.

FIG. 2 shows the working apparatus 28, the discharge line system 56 and the discharge tank 58 with the support bracket 60 in a perspective view at an angle from the front and above. The tank wall 58*b* facing the viewer in FIG. 1 is omitted in FIG. 2 in order to show and explain the inner life of the discharge tank 58.

The discharge tank 58 of the illustrated exemplary embodiment is designed in mirror symmetry with respect to a central vertical plane, which is oriented in parallel with respect to the vertical machine direction H and to the longitudinal machine direction L. The side wall facing away from the viewer of FIGS. 1 and 2, which is parallel to the side wall 58*a* shown in FIG. 1, therefore also has a maintenance cover 80 for closing a maintenance opening, an inspection glass 84 and a cleaning cover 82 for closing a cleanout opening.

The stirring apparatus 102 has on its longitudinal end opposite the shaft end 100 a stirring tool 104, for example having four stirring blades adjusted with respect to the axis of rotation of the stirring apparatus 102, which are situated at intervals of 90° about the axis of rotation of the stirring apparatus 102. Due to the mirror symmetry of the discharge tank 58, a second stirring tool is provided, which is not shown in FIG. 2, since it is identical to the illustrated front stirring tool 104.

A partition wall 106 running in the plane of mirror symmetry across the bottom 58*d* is to prevent settling particles P from collecting in the transverse center of the bottom 58*d*. For, as can be seen in FIG. 2, the transfer pump 92 withdraws liquid coolant from the discharge tank 58 via a transfer line 94 not only on the side facing the viewer, but also on the side facing away from the viewer. On the side facing away from the viewer, however, only the connecting flange 94*a* for connecting a further transfer line is shown. The further transfer line itself, which is in mirror symmetry to the illustrated transfer line 94, is not shown.

Partition wall 106 is situated so as to ensure that no particle sediment remains permanently in the transverse center between the two suction locations of the transfer pump 92 in the discharge tank 58.

In the rear area of the discharge tank 58, in the area of partition wall 106, a further cleanout opening 107 may be developed, which may likewise be closed by a circular cover.

Approximately at the vertical center of the discharge tank 58, distributed over a central area extending in the vertical machine direction H, three reinforcing crossbars 108 are arranged by way of example running in the transverse machine direction Q between the side walls of the discharge tank 58. One of the crossbars 108 runs coaxially with respect to the axis of inclination N and reinforces the discharge tank 48 directly in the transverse machine direction Q between the pivot points of the retaining fork 76 of the support bracket 60.

Three lines carrying liquid coolant C lead by way of example from the discharge line system 56 into the rear side wall of the tank 58, which faces the rear end of the earth working machine 10 when the discharge tank 58 is in the operational position on the machine frame 16. The three lines of the discharge line system 56 open in the vertical machine direction H in the area of the uppermost 15 to 20% of the vertical extension of the discharge tank 58 in order to ensure that even when the discharge tank 58 is filled to a high level with liquid coolant C there is still a direct connection between the vacuum apparatus 86 and the opening of the discharge line system 56, so that the underpressure produced in the discharge tank 58 by the vacuum apparatus 86 is able to act on the discharge line system 56 directly and without counteraction of a back pressure produced by the liquid coolant C collected in the discharge tank 58.

Via slot nozzles 110, the discharge line system 56 withdraws liquid coolant C from the working unit 32 essentially over at least 80%, preferably over at least 90% of the extension of the working apparatus 28 in the transverse machine direction Q, in the longitudinal machine direction L both in front of the engagement zone E of the engagement of the working apparatus 28 with the contact area U to be worked as well as behind the engagement zone E.

In order to protect for example the stirring apparatus 102 with its stirring tool 104 against the impact of particle-containing liquid coolant C rushing into the discharge tank 58, a baffle 112, made for example of a reinforced elastomer, is situated in the discharge tank 58 at a distance from the opening of the discharge line system 56 into the discharge tank 58. The baffle 112 may be securely anchored in the discharge tank 58 by a metal frame 114. Liquid coolant C rushing into the tank then strikes the baffle 112 and runs off from it. Apart from the stirring apparatus 102, the baffle 112 also protects the vacuum apparatus 86 against direct contact with the particle-containing liquid coolant C flowing into the discharge tank.

The discharge tank 58 may be swivable about the common axis of bolts 68 and 72 running in parallel to the vertical machine direction H. In order to swivel the discharge tank 58, a swivel actuator already existing on the machine frame 16 for swiveling the conveyor belt may be used, which engages on the support bracket 60.

The coupling of the discharge tank 58 to the retaining fork 76 is explained in as follows: A pin 116 running along the axis of inclination N protrudes outward from the side wall 58*b* (shown only in FIG. 1) of the discharge tank 58. The mirror-symmetrical design of the discharge tank 58 explained above also applies to the coupling of the discharge tank 58. The pin 116 is designed to be rotationally symmetric with respect to the axis of inclination, so that the pin 116 is a hinge pin of an inclination hinge formed in combination with the retaining fork 76.

In the coupling situation with the retaining fork 76 shown in FIGS. 1 and 2, the pin 116 is surrounded by a generally U-shaped encompassing section 118, which encompasses the pin 116 on its circumferential section facing the contact area U over approximately 180°.

The encompassing section 118 open in the upward direction has an insertion opening 120, through which the pin 116 was inserted into the encompassing section 118.

The machine operator of the earth working machine 10 is able to perform the movements required for inserting the pin 116 into the encompassing section 118 with the aid of traveling gear 12 and the lifting columns 26. To mount the discharge tank 58 disengaged from the earth working machine 10 or from its machine body 14, the machine operator lowers the machine body 14 with the support bracket 60 so that the entire encompassing section 118 is lower than pin 116. Subsequently, the machine operator brings the machine body 14 close to the discharge tank 58 such that the insertion opening 120 is underneath the pin 116 in the vertical machine direction H. In this situation, the machine operator raises the machine body 14 together with the support bracket 60 so that the pin is inserted into the opening of the encompassing section 118. A catch 122 allows for a relative movement of the pin 116 along the vertical machine direction into the opening of the encompassing section 118 and blocks an opposite relative movement of the pin 116 out of the encompassing section 118.

In this situation, the machine operator attaches the manual actuator 78 to the associated fastening eye on the discharge tank 58. The manual actuator 78 is likewise attached to the fastening eye provided for this purpose on the cross bar 76*c* of the retaining fork 76. By operating the manual actuator 78, for example by rotating a greater-diameter internal thread section 78*a* of the actuator component connected in the illustrated exemplary embodiment to the fastening eye of the discharge tank 58 relative to the external thread of a threaded rod 78*b* connected to the fastening eye of the cross bar 76*c*, the machine operator is able to set the relative inclination position of the discharge tank 58 relative to the support bracket 60 about the axis of inclination N. This adjustment work is possibly facilitated if the discharge tank 78 is lifted off the ground U by lifting columns 26.

A removal of the discharge tank 78 occurs in the reverse work sequence, it being necessary to adjust the catch 122 actively into its release position in which it is withdrawn from the insertion opening 120. This may be done manually or by an actuator provided with the catch 122.

The invention claimed is:

1. A self-propelled earth working machine, comprising:
a machine frame;
a traveling gear supporting the machine frame;
a power source supported from the machine frame and configured to supply the earth working machine with power;
a working unit including a housing enclosure for providing an earth working zone;
a cutting drum rotatable about a working axis and accommodated in the working unit and configured for earth working operation;
a liquid coolant supply configured to conduct liquid coolant into the working unit;
a discharge tank configured to hold liquid coolant and supported from the machine frame; and
a discharge line system connecting the working unit to the discharge tank and configured to conduct liquid coolant from the working unit into the discharge tank;
wherein the machine frame includes a conveyor belt holding fixture configured to releasably accommodate a conveyor belt for transporting removed earth material away from the working unit; and
wherein the discharge tank is releasably mounted on the conveyor belt holding fixture in exchange for the conveyor belt.

2. The self-propelled earth working machine of claim 1, wherein:
the discharge tank includes a vacuum apparatus configured to remove gas from the discharge tank.

3. The self-propelled earth working machine of claim 1, wherein:
the discharge tank includes an agitator configured to keep liquid coolant collected in the discharge tank in motion.

4. The self-propelled earth working machine of claim 1, further comprising:
a transfer pump configured to transfer liquid coolant collected in the discharge tank from the discharge tank.

5. The self-propelled earth working machine of claim 1, further comprising:
a filter apparatus configured to filter particles which are suspended in the liquid coolant collected in the discharge tank out of the liquid coolant.

6. The self-propelled earth working machine of claim 1, further comprising:
a transfer pump configured to transfer liquid coolant collected in the discharge tank from the discharge tank;
a filter apparatus configured to filter particles which are suspended in the liquid coolant collected in the discharge tank out of the liquid coolant;
a reservoir configured to provide the liquid coolant for use by the liquid coolant supply; and
a return line connecting the discharge tank to the reservoir;
wherein the transfer pump and the filter apparatus are disposed in the return line.

7. The self-propelled earth working machine of claim 1, further comprising:
a baffle located in the discharge tank downstream from an inlet of the discharge line system into the discharge tank.

8. The self-propelled earth working machine of claim 1, further comprising:
at least one connection formation communicating with the discharge tank and configured for temporary connection of a fluid line to the discharge tank.

9. The self-propelled earth working machine of claim 1, wherein:
the working unit is a swappable working unit that is releasable from the machine frame according to an intended use of the working unit.

10. The self-propelled earth working machine of claim 1, wherein:
the discharge tank is swivel mounted on the machine frame such that the discharge tank may be swiveled about a swivel axis parallel to a yaw axis of the earth working machine.

11. The self-propelled earth working machine of claim 10, further comprising:
a swivel actuator configured to perform a swiveling movement of the discharge tank about the swivel axis.

12. The self-propelled earth working machine of claim 1, wherein:
the traveling gear includes at least three wheels or tracks rollable on a contact area of the earth working machine, at least one of the wheels or tracks being steerable; and
the cutting drum is located longitudinally between a front end of a front-most one of the wheels or tracks and a rear end of a rear-most one of the wheels or tracks when the wheels or tracks are oriented for straight-ahead travel of the earth working machine.

13. A self-propelled earth working machine, comprising:
a machine frame;
a traveling gear supporting the machine frame;
a power source supported from the machine frame and configured to supply the earth working machine with power;
a working unit including a housing enclosure for providing an earth working zone;
a cutting drum rotatable about a working axis and accommodated in the working unit and configured for earth working operation;
a liquid coolant supply configured to conduct liquid coolant into the working unit;
a discharge tank configured to hold liquid coolant and supported from the machine frame; and
a discharge line system connecting the working unit to the discharge tank and configured to conduct liquid coolant from the working unit into the discharge tank;
wherein the discharge tank is inclinable relative to the machine frame about an axis of inclination parallel with respect to a contact area of the earth working machine.

14. The self-propelled earth working machine of claim 13, further comprising:
an inclination actuator configured to perform an inclining movement of the discharge tank about the axis of inclination.

* * * * *